US006474895B2

(12) United States Patent
Hori

(10) Patent No.: US 6,474,895 B2
(45) Date of Patent: Nov. 5, 2002

(54) WRITING INSTRUMENT AND METHOD OF PRODUCING THE SAME

(75) Inventor: Jiro Hori, Tsurugashima (JP)

(73) Assignee: HICS Corporation (JP)

( * ) Notice: Subject to any disclaimer, the term of this patent is extended or adjusted under 35 U.S.C. 154(b) by 0 days.

(21) Appl. No.: 09/864,533

(22) Filed: May 24, 2001

(65) Prior Publication Data

US 2002/0018690 A1 Feb. 14, 2002

Related U.S. Application Data

(63) Continuation of application No. PCT/JP99/06579, filed on Nov. 25, 1999.

(30) Foreign Application Priority Data

Nov. 27, 1998 (JP) ..... 10-337376
Nov. 27, 1998 (JP) ..... 10-337377

(51) Int. Cl.[7] ..... B43K 5/18
(52) U.S. Cl. ..... 401/232; 401/205
(58) Field of Search ..... 401/198, 199, 401/232, 205, 206

(56) References Cited

U.S. PATENT DOCUMENTS 3,345,674 A * 10/1967 De Groft ..... 401/198
3,397,939 A 8/1968 Berry
3,421,823 A * 1/1969 Matsumoto ..... 401/199
3,792,932 A * 2/1974 Henriksen
4,588,319 A * 5/1986 Niemeyer ..... 401/199
4,776,718 A * 10/1988 Heinzmann et al. ..... 401/198
4,973,180 A * 11/1990 Hori ..... 401/198
5,967,687 A * 10/1999 Oike ..... 401/198
6,095,707 A * 8/2000 Kaufmann ..... 401/198

FOREIGN PATENT DOCUMENTS

| | | |
|---|---|---|
| JP | 1417143 | 11/1939 |
| JP | 362745 | 12/1949 |
| JP | 5848484 | 4/1983 |

* cited by examiner

*Primary Examiner*—Charles R. Eloshway
(74) *Attorney, Agent, or Firm*—Jones, Day, Reavis & Pogue

(57) ABSTRACT

A writing instrument has an accurate operation and simple structure in a mechanism for controlling ink supply by air enclosed in an ink passage, and a method of producing the same. The ink is blocked by the air enclosed in a blocking chamber (11), the blocking chamber communicates with an ink holding passage (18) and has a porous relay body (15) inserted therein, an ink storing portion (17) is formed in a base portion of the relay body, the ink in the ink holding passage (18) descends and contacts the relay body (15) as the ink in the ink storing portion is consumed, and thereby is transferred to the ink storing portion, and the air is prevented from being absorbed into the porous relay body (15).

25 Claims, 6 Drawing Sheets

WRITING INSTRUMENT AND METHOD OF PRODUCING THE SAME

CROSS-REFERENCE TO RELATED APPLICATIONS

This application is a continuation of International Application No. PCT/JP99/06579 filed Nov. 25, 1999, which claims dual priority of Japanese Patent Application No. 10/337376 filed Nov. 27, 1998, and Japanese Patent Application No. 10/337377 filed Nov. 27, 1998.

1. Technical Field

The present invention relates to a writing instrument for controlling ink supply to a writing element, and more particularly to a writing instrument and method of producing the same for controlling the ink supply by a gas enclosed in a blocking chamber with a small volume which has the gas such as air enclosed therein, and which is provided inside an ink supplying passage extending from an ink chamber to the writing element.

2. Background Art

In general, in a writing instrument of the type storing liquid ink in an ink chamber, it is necessary to control a flow amount and pressure of the ink being supplied from the ink chamber to a writing element. As the simplest type of such an ink control, there is a method for providing a porous member referred to as a relay core made of a bundle of fibers between an ink chamber and writing element, while pulling the ink out of the ink chamber by the capillary force of the relay core, and controlling a supply amount of ink by the resistance received by the ink flowing inside the relay core.

In addition, the capillary force exists in a writing element due to fine gaps between fibers when the writing element forms a so-called felt chip made of a bundle of fibers, or due to a fine gap between a ball and a ball holder when the writing element forms a ball chip. Such a capillary force causes the writing element to have an ink pulling force for pulling the ink and an ink holding force for holding the pulled ink.

Therefore, the above-mentioned control only by the relay core has not been able to stabilize the ink supply. That is, if the density of the relay core is reduced to decrease the flow resistance of the ink, when the writing instrument is not used for writing, the ink in the ink chamber is pulled out of the chamber by the ink pulling force of the writing element described above, and the writing element contains a large amount of the ink to be saturated, and becomes so-called ink rich state. As a result, a disadvantage arises that writing becomes undesirably thick at the beginning of the writing. Particularly in a ball chip using water-soluble ink, the ink pulling force and ink holding force have the hydraulic pressure head of only the order of a few ten to a hundred mm. Therefore, in a condition that this writing instrument is allowed to stand, i.e., that the ball chip is directed downward, it sometimes happens that a small amount of ink is pushed out of the gap between the ball and ball holder, due to the hydraulic pressure head of the ink existing in a portion from the ink chamber to the ball chip. When writing is started in such a condition, a disadvantage arises that a starting portion of the writing line becomes a shape of a comma (,).

In order to avoid the disadvantage, it is required to increase the density of the relay core to increase the capillary force and inner flow resistance, however, thus increasing causes the ink flowing inside the relay body to receive an excessive flow resistance. Hence, in the case of writing fast or the like, the supply of ink is insufficient, and a condition, so-called ink poor condition, occurs that an ink amount contained in the writing element is too small. As a result, a disadvantage may occur such that the writing becomes blurred.

In order to avoid the disadvantage, various ink control mechanisms have been considered conventionally. One of the mechanisms is to provide between an ink chamber and writing element a small mechanical valve mechanism that is opened by a predetermined pressure difference. In this mechanism, the valve mechanism is closed at the time the writing instrument is not used for writing, and thereby the ink is prevented from being supplied excessively to the writing element. Then, at the time the instrument is used for writing, the valve mechanism is opened due to a pressure difference caused by the ink pulling force of the writing element, and thereby the ink is supplied from the ink chamber to the writing element.

However, the above-mentioned valve mechanism is required to operate to be opened or closed by a small pressure difference of the hydraulic pressure head of the order of a few ten mm, and is further required to be formed to extremely small, and therefore has a disadvantage that the production, quality control and the like thereof become complicated. Further, in the case where the writing element forms the ball chip using water-soluble ink described previously, since the ink pulling force is low, the pressure for opening or closing such a valve mechanism should be set extremely finely, and thereby a disadvantage occurs that the production, quality control and the like thereof become complicated.

Further, as another ink control type, there is a so-called air chamber type in which a small chamber with air enclosed therein is provided between an ink chamber and a writing element. In general, when air exists in a liquid passage with a small cross-sectional area, a phenomenon, so-called vapor lock, occurs that the air becomes bubbles, thereby blockades the passage and blocks the flow of the liquid. The air chamber type uses the principle of this phenomenon to configure a kind of valve mechanism.

The air chamber type of instrument does not essentially require a mechanically movable portion such as a valve, and has advantages that the structure is simple and that the production is easy. However, the air chamber type of instrument naturally requires a mechanism for flowing the ink blocked by the internal bubbles at the time of writing, and therefore provides a problem that it is difficult to reserve the stability of the operation in the mechanism.

An example of the air chamber type of writing instrument is disclosed in U.S. Pat. No.3,397,939. In the writing instrument, a small chamber with air enclosed therein is formed in an ink passage provided between an ink chamber and a writing element, is opened in its upper portion into a passage which communicates with the ink chamber, and is filled in its lower portion with a porous filler which communicates with the side of the writing element.

In the instrument of the USP, when the instrument is not used for writing, the porous filler contains the ink to be almost saturated, and the air enclosed in the small chamber blocks the flow of ink. Then, when the ink contained in the filler is consumed by the writing and the porous filler becomes the ink poor condition, the air inside the small chamber is absorbed into the porous filler. Since the air inside the small chamber is thus absorbed into the filler, the ink flows into the small chamber from the above-mentioned passage, and is absorbed into the filler. Then, when the filler with the ink absorbed therein becomes the ink rich condition, the air absorbed into the filler is released to the small chamber to block the flow-in of the ink.

The instrument disclosed in the USP does not have a mechanically movable portion, has a simple structure, and is capable of controlling the flow of ink assuredly even when the ink pulling force of the writing element is low. However, a case sometimes occurs that the whole amount of air absorbed into the porous filler is not released when the ink is newly absorbed into the filler. Then, the air remaining in the filler flows as the ink in the filler flows by writing, and when the remaining air reaches the writing element, the ink pulling force of the writing element is decreased, and the writing becomes impossible or has an inconvenience.

In order to avoid the above-mentioned disadvantage, the instrument of the USP is configured so that the upper portion of the small chamber is formed in the shape of a cone, and that when the ink flows into the chamber from the passage communicating with the ink chamber, the ink drops along the inner periphery of the small chamber to be absorbed in the periphery of the filler filled in the lower portion of the small chamber. By such a configuration, the ink penetrates from the periphery to the center portion of the filler, and thereby the air absorbed in the filler collects towards the center portion to be released.

However, according to the experiment by the inventor of the present invention and others, in the instrument configured as described above, it was still difficult to release the whole amount of the air once absorbed into the porous filler by ink newly being absorbed, and further it was difficult to assuredly prevent the air from remaining in the filler.

Disclosure of Invention

The present invention has been carried out in view of the foregoing, and it is an object of the present invention to provide a writing instrument and method of producing the writing instrument which uses an air chamber type of ink control mechanism requiring no mechanically movable portion, having a simple structure, and operating to be opened and closed by small pressure difference, and which enables the mechanism for blocking and flowing ink by enclosed gas to provide high reliability.

A writing instrument of the present invention is provided with an ink chamber that stores ink, a writing element provided on a front end portion of the writing instrument, and an ink control mechanism provided between the ink chamber and the writing element, where the ink control mechanism comprises a blocking chamber with a gas housed therein, an ink-chamber-side passage for causing the blocking chamber to communicate with the ink chamber, a writing-element-side passage for causing the blocking chamber to communicate with the writing element, an ink storing portion formed in the blocking chamber to store and hold a small amount of ink while communicating with the writing-element-side passage, ink holding means for holding the ink entering the blocking chamber from the ink-chamber-side passage at a predetermined position in the blocking chamber, and ink relay means for transferring, when an amount of the ink held by the ink holding means is equal to or more than a predetermined amount, at least part of the held ink to the ink storing portion.

Thus, when the instrument is not used for writing, the gas, for example, air enclosed in the blocking chamber blocks the communication of the ink between the ink chamber and the writing element, and the ink is thereby prevented from being supplied undesirably to the writing element.

Then, when the ink is consumed by the writing, the ink stored in the ink storing portion is consumed, the volume of a spatial portion of the blocking chamber increases corresponding to the consumed amount of ink, and the air pressure inside the blocking chamber decreases. The ink thereby enters the blocking chamber from the ink-chamber-side passage, and the entering ink is temporarily held at the predetermined position by the ink holding means. When an amount of the ink held by the ink holding means exceeds the predetermined amount, the ink is transferred to the ink storing portion by the ink relay means. Ink is thereby stored again in the ink storing portion, whereby the gas pressure inside the blocking chamber returns to an initial state, and thereafter, the similar operation is repeated to supply the ink to the writing element.

This ink control mechanism is the air chamber type of ink control mechanism described previously, does not require a mechanically movable portion, and enables itself to assuredly operate to be opened and closed by small pressure difference. The block and communication of the ink by the enclosed air is performed by increase and decrease in the ink amount stored and held in the ink storing portion. Accordingly, it is not necessary to perform operations in the porous member for absorbing the air, causing the ink to penetrate, eliminating the air, etc., and therefore the mechanism has a reliable operation and a simple structure.

Further, according to a preferred embodiment, the blocking chamber has an inner diameter enabling the ink to be held in a liquid-cylindrical form in one end portion thereof, has a predetermined amount of a gas enclosed therein, and further has an ink relay body which projects into the blocking chamber from a side of the other end portion thereof, which communicates in its proximal end portion with the ink-chamber-side passage, which has a front end portion formed in a pointed shape being disposed adjacent a free surface of the ink held in a liquid-cylindrical form in the blocking chamber, and which transfers part of the ink to the writing-element-side passage by contacting the free surface.

Thus, when the instrument is not used for writing, the gas enclosed in the blocking chamber blocks the communication of the ink between the ink-chamber-side passage and the writing-element-side passage, and thereby the undesirable supply of the ink to the writing element is halted. Then, when the ink of the writing-element-side passage is consumed by the writing, the volume of a spatial portion of the blocking chamber increases corresponding to the consumed amount of ink, the enclosed gas pressure decreases to move the ink held in a liquid-cylindrical form, the free surface of the ink contacts the front end portion of the ink relay body, and thereby part of the ink is transferred to the writing-element-side passage. Thus, the volume of the spatial portion of the blocking chamber decreases to increase the gas pressure, the free surface of the ink held in a liquid-cylindrical form moves backward to be spaced apart from the front end of the ink relay body, and thereby the supply of the ink is halted. Accordingly, it is possible to supply the ink with the predetermined amount only when the instrument is used for writing.

Since the ink entering blocking chamber from the ink-chamber-side passage is held in a liquid-cylindrical form as described above, a clear free surface is formed in the front end portion of the ink. Further, since the front end portion of the ink relay body is formed pointedly, it is possible to dispose the front end portion adjacent the free surface of the ink held in a liquid-cylindrical form. Accordingly, when the ink of the writing-element-side passage is consumed even a little, the free surface contacts the front end portion of the ink relay body, and the ink is transferred to the side of the writing element. Therefore, the ink passage extending from the ink relay body to the writing element maintains the condition that the passage is always filled with the ink, and it does not happen that the gas of the blocking chamber enters the passage and is mixed with the ink. As a result, it is possible to assuredly prevent the gas from being transferred to the writing element with the ink.

Further, the producing method of the present invention comprises the steps of holding the writing instrument, provided with the ink control mechanism of dry condition with no ink contained therein, in a generally vertical posture with the writing element thereof directed downward, of injecting the ink into the ink chamber, of evacuating the gas in the blocking chamber through the ink relay means of dry condition by flowing the ink injected into the ink chamber to the ink holding means in the ink control mechanism, and of halting the evacuation of the gas through the ink relay means by flowing the injected ink to the ink relay means in the ink control mechanism, and thereby enclosing the gas with a predetermined amount remaining in the blocking chamber.

Accordingly, by a simple operation for holding the writing instrument of dry condition in a generally vertical posture and injecting the ink into the ink chamber, it is possible to accurately enclose a gas with a required predetermined amount in the blocking chamber, and to produce the writing instrument with accurate characteristics efficiently and assuredly.

BEST MODE FOR CARRYING OUT THE INVENTION

Embodiments of the present invention will be described below with reference to accompanying drawings. FIGS. 1 to 8 show a first embodiment of the present invention. A writing instrument of this embodiment is of a disposable type provided with a ball chip using water-soluble ink.

Figure 1:
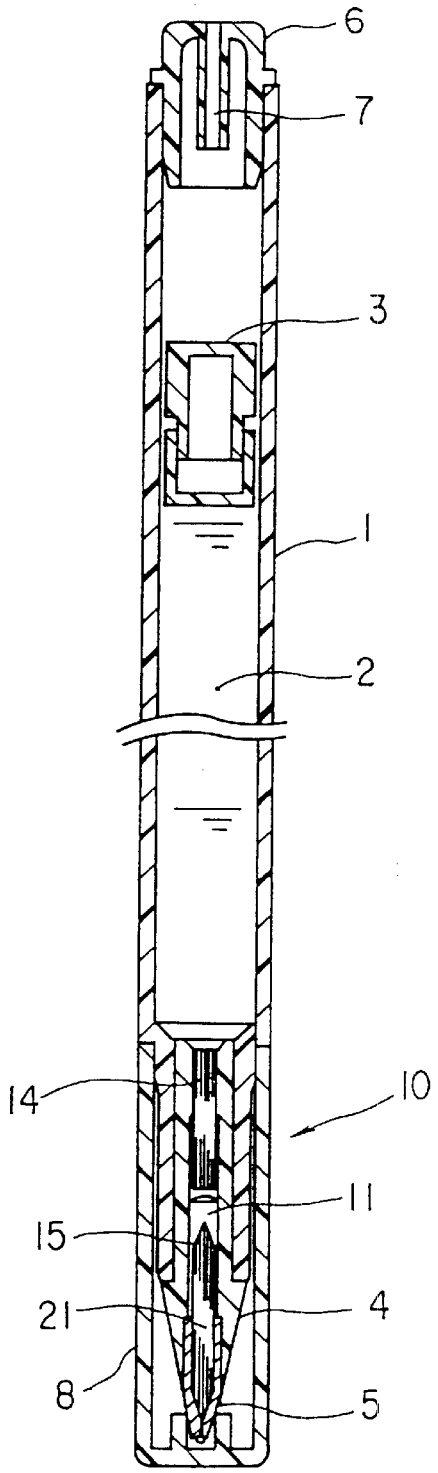
FIG. 1 is a longitudinal cross-sectional view of a first embodiment of a writing instrument according to the present invention.

"1 " in FIG. 1 denotes an axial barrel of the writing instrument, and in the axial barrel 1 is formed an ink chamber 2 for storing water-soluble ink. The ink chamber 2 has the liquid ink stored therein, and further has a slide plug 3 inserted therein for dividing the ink and air.

A gap is formed between the outer periphery of the slide plug 3 and the inner periphery of the ink chamber 2. The slide plug 3 maintains a non-contact condition with respect to the inner periphery of the ink chamber 2, and is set so that the slide resistance is substantially zero. In addition, a liquid membrane of the ink exists between the slide plug 3 and the inner periphery of the ink chamber 2, thereby prevents the direct contact therebetween and maintains the sealing characteristic therebetween.

The slide plug 3 is formed to have a specific gravity lower than the ink by being formed, for example, in a hollow shape, and thereby is floatable with respect to the ink. Accordingly, the slide plug 3 does not subside when the writing instrument is allowed to stand upward, and the ink and slide plug 3 do not descend due to the sealing characteristic when the instrument is turned upside down, thereby always dividing the ink and air in the ink chamber 2 assuredly.

The slide plug 3 moves corresponding to expansion, contraction, etc. of the ink to compensate for the expansion and contraction, while going forward as the ink is consumed. In addition, the rear end portion of the ink chamber 2 is closed by an end plug 6, and in the end plug 6 is formed an atmosphere communicating tube 7 through which the air side of the ink chamber 2 communicates with the atmosphere. Accordingly, the pressure of the ink inside the ink chamber 2 is always maintained at the pressure equal to the atmospheric pressure. In addition, a small amount of silicone oil or the like is enclosed inside on the air side of the ink chamber to reserve the sealing accurately, and the atmosphere communicating tube 7 prevents the silicone oil from leaking outside.

On the front end portion side of the axial barrel 1 is provided a writing element holder 4, and on the frond end portion of the writing element holder 4 is provided a writing element, specifically a ball chip 5 with the water-soluble ink in this embodiment. Further, the axial barrel 1 is on its front end portion engaged with a cap 8 detachably. The writing element, for example, ball chip 5 communicates with the ink chamber 2 through an ink control mechanism 10 described below.

Figure 2:
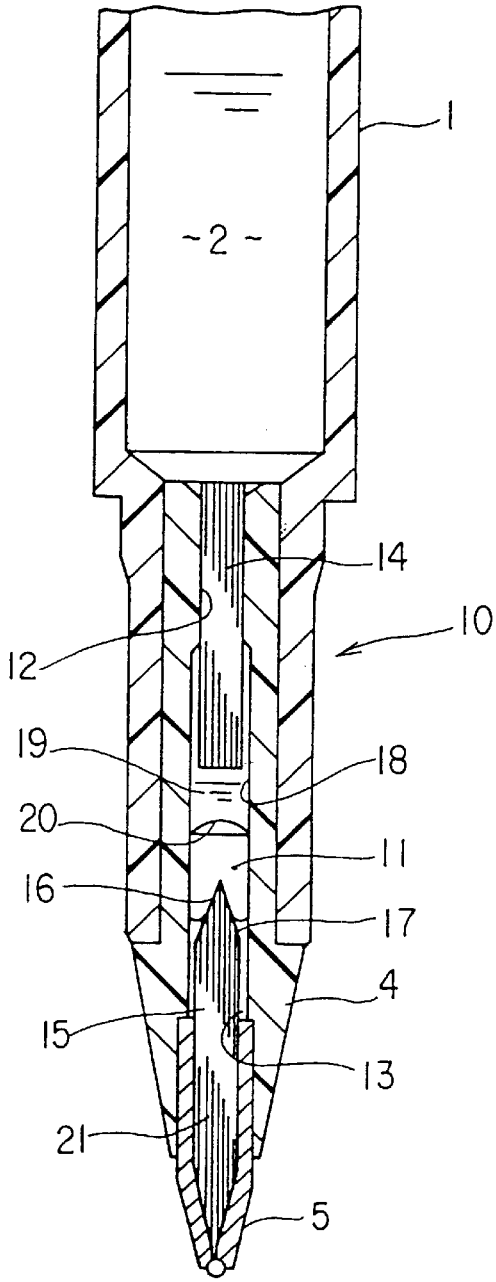
FIG. 2 is a longitudinal cross-sectional view of an ink control mechanism of the first embodiment of the writing instrument according to the present invention.

FIG. 2 shows an enlarged view of the ink control mechanism 10. The ink control mechanism 10 has a blocking chamber 11 with a small volume. In this embodiment, in the center of the writing element holder 4 is provided a straight-shaped through hole in the axial direction. The center portion of the through hole is formed as the blocking chamber 11. The through hole on the upper side of the blocking chamber 11 communicates with the ink chamber 2, and thereby forms an ink-chamber-side passage 12. The through hole on the lower side of the blocking chamber 11 communicates with the ball chip 5, and thereby forms a writing-element-side passage 13. In the blocking chamber 11 is enclosed a gas, air in this embodiment, with a predetermined amount.

In the ink-chamber-side passage 12 is inserted an ink-chamber-side relay core 14. The ink-chamber-side relay core 14 is made of a porous material such as a bundle of fibers in the form of a rod, and thereby pulls out the ink from the ink chamber 2 due to the capillary force caused by fine gaps between the fibers, while providing a predetermined flow resistance to the ink flowing therein.

A portion between an upper portion of the blocking chamber 11 and the ink-chamber-side passage 12 forms an ink holding passage 18 as the ink holding means for holding the ink. In this embodiment, the ink holding passage 18 is continuous with the blocking chamber 11 and has the same diameter as the chamber 11. Ink 19 having flowed inside the passage 18 has a free surface formed on its lower surface by surface tension, and is held in a liquid-cylindrical form.

The ink holding passage 18 has a small diameter, whereby the lower end of the ink 19 held in a liquid-cylindrical form is held due to a surface tension of the free surface 20, and the passage 18 is configured so as to prevent part of the ink 19 in a liquid-cylindrical form from being exchanged with the air of the blocking chamber 11 and flowing in the chamber 11. In order to achieve such a holding effect, it is preferable to set an inner diameter of the ink holding passage 18 to, for example, a value equal to or less than 3 mm. In addition, this value is preferable in the case of using water-soluble ink, and the inner diameter varies depending on kinds of the ink to be used. In general, the inner diameter of the ink holding passage 18 equal to or less than 6 mm prevents the ink being exchanged with the air, and enables the ink to be held in a liquid-cylindrical form.

In the writing-element-side passage 13 is inserted a writing-element-side relay core 21 for supplying the ink to the ball chip 5, and the writing-element-side relay core 21 is also formed from the same material as the ink-chamber-side relay core 14. In this embodiment, an upper portion of the writing-element-side relay core 21 projects into a lower portion of the blocking chamber 11, and is formed as a relay body 15 which forms the ink relay means.

The front end portion of the relay body 15 is provided with a cone portion 16 in a pointed form. A slight gap is formed between the outer periphery of the relay body 15 and the inner periphery of the blocking chamber 11. Between the outer periphery of the proximal end portion of the cone portion 16 of the relay body 15 and the inner periphery of the blocking chamber 11 is formed an annular gap with a wedge-shaped cross section, and the gap is formed as an ink storing portion 17.

In this embodiment, the ink-chamber-side relay core 14 is formed to have its density greater than that of the writing-element-side relay core 21, and therefore the flow resistance of the ink flowing through the ink-chamber-side relay core 14 is set to a value greater than the flow resistance of the ink flowing through the writing-element-side relay core 21.

Figure 3:
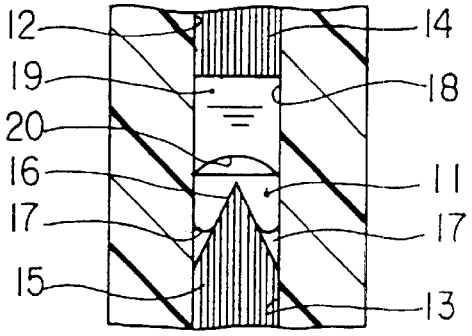
FIG. 3 is an explanatory view of an operation of the first embodiment of the writing instrument according to the present invention.
Figure 4:
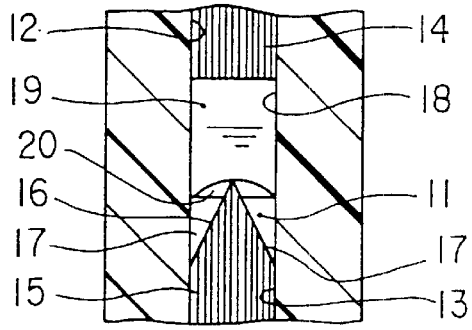
FIG. 4 is another explanatory view of the operation of the first embodiment of the writing instrument according to the present invention.
Figure 5:
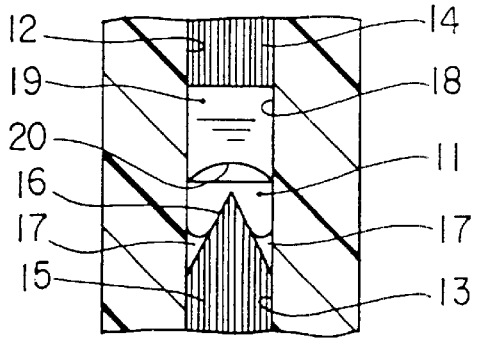
FIG. 5 is another explanatory view of the operation of the first embodiment of the writing instrument according to the present invention.

The operation of the first embodiment will be described with reference to FIGS. 3 to 5. FIG. 3 shows part of the writing instrument being not used for writing. A predetermined small amount of air is enclosed in the blocking chamber 11, and blocks the ink of the ink-chamber-side passage 12 and the ink of the writing-element-side passage 13. In this case, the ink flows from the ink-chamber-side passage 13 into the ink holding passage 18, however, as described previously, the ink 19 has the lower surface formed as the free surface 20 due to the surface tension, and is held in a liquid-cylindrical form. The writing-element-side relay core 21 and the relay body 15 provided in the upper portion of the core 21 are almost saturated with the ink, and therefore have a so-called ink rich condition. In the ink storing portion 17 provided in the proximal portion of the cone portion 16 of the relay body 15 is stored and held the liquid ink with a predetermined amount due to the capillary force.

In such a condition that the writing instrument is not used for writing, the ink in the ink holding passage 18 is blocked by the air in the blocking chamber 11, and is held at a predetermined position as described previously. Then, in this case, the communication between the ink of the ink-chamber-side passage 12 and the ink of the writing-element-side passage 13 is blocked, and thereby the ink is not supplied undesirably from the ink chamber 2 to the writing element, i.e., ball chip 5. The ball chip 5 is thereby prevented from containing excessive ink.

When the writing instrument is used for writing, the ink in the writing-element-side relay core 21 is consumed. In this case, since the liquid ink is stored and held in the ink storing portion 17 in the periphery of the proximal portion of the relay body 15 provided in the upper portion of the writing-element-side relay core 21, the ink in the ink storing portion 17 is consumed preferentially.

That is, when the ink in the saturated porous material, i.e., the writing-element-side relay core 21 and relay body 15 in this case, is consumed, a load is required to some extent in order for the ink existing in a saturated condition on surfaces of the core 21 and of the body 15 to be drawn inside from the surface of the porous relay body 15. However, the ink stored and held in the ink storing portion 17 is in contact with the outer periphery of the proximal portion of the relay body 15, and in the contact portion, the surface of the proximal portion of the relay body 15 is dipped into the ink and is saturated with the ink. Accordingly, as the ink in the relay body 15 is consumed, the ink is absorbed from a portion with the least resistance, i.e., the ink storing portion 17, whereby the ink in the ink storing portion 17 is consumed preferentially.

When the ink in the ink storing portion 17 is thus consumed, the volume of a spatial portion of the blocking chamber 11 increases corresponding to the consumed amount of ink, whereby the pressure of the air enclosed in the blocking chamber 11 decreases. Thus, as shown in FIG. 4, the liquid-cylindrical ink 19 held in the ink holding passage 18 descends to compensate for the pressure decrease. Then, when the free surface 20 of the liquid-cylindrical ink 19 contacts the front end portion of the cone portion 16 of the relay body 15, part of the surface tension of the free surface 20 is broken due to the fact that the surface of the cone portion 16 is wet with the ink, and thereby part of the ink is transferred to the ink storing portion 17, while flowing along the surface of the cone portion 16.

When the ink is stored in ink storing portion 17, the volume of the spatial portion in the blocking chamber 11 decreases corresponding to the stored amount of ink, and the pressure of the air enclosed in the spatial portion increases, thereby pushing up the liquid-cylindrical ink 19 in the ink holding passage 18. Thus, as shown in FIG. 5, the free surface 20 is disposed apart from the cone portion 16 again, and recovers the condition as shown in FIG. 3.

When the writing instrument is used continuously for writing, the ink in the ink storing portion 17 is consumed again, the operation as described above is repeated, and the ink in the ink chamber 2 is supplied to the ball chip 5. In addition, since the volume of the blocking chamber 11 is small and the relay body 15 or the like is also small in its size, when the free surface 20 of the ink 19 in the ink holding passage 18 contacts the front end of the cone portion 16 of the relay body 15, part of the ink 19 is transferred to the ink storing portion 17 in an extremely short time.

The operation described above is basically an intermittent operation. Accordingly, during the continuous use for writing, the ink is supplied to the ball chip 5 intermittently by the intermittent operation described above. However, since the intermittent ink supplying operation is repeated at extremely short intervals as described above and the writing-element-side relay core 21 has the ink storing capability to some extent, the ink is stably and continuously supplied to the ball chip 5, and the writing does not cause concentration differences.

In this embodiment, the ink-chamber-side relay core 14 is set to have the higher density and the higher ink flow resistance than the writing-element-side relay core 21. Thereby, the ink supplied to the ball chip 5 is pulled back.

That is, in the ball chip, the ink adhered on the surface of the ball is transferred to a writing surface of paper or the like due to the rotation of the ball. As described previously, the ink is held due to the capillary force in the slight gap between the ball and the ball holder holding the ball rotatably, and the liquid ink is also held in a ball holding portion in the ball holder. Accordingly, even when the supply of the ink is controlled as described above, it sometimes happens that a slight amount of the ink is pushed out of the gap between the ball and the ball holder in the case where the rotation of the ball is suddenly halted to stop the writing. If the pushed out ink thus exists excessively on the periphery of the ball, when the writing instrument is used next to start writing, a starting portion of the writing line becomes a shape of a comma (,) as described previously, providing the problem that the writing appearance deteriorates.

In this embodiment, since the ink in the ink storing portion 17 is always consumed continuously during the period of the time the ink is consumed by the writing, the pressure inside the blocking chamber 11 is of a negative pressure. When the writing is finished, due to the negative pressure inside the blocking chamber 11, the ink flows into the blocking chamber 11 from the ink-chamber-side passage 12 and the writing-element-side passage 13. In this case, since the flow resistance of the ink-chamber-side relay core 14 in the ink-chamber-side passage 12 is set to be greater than the flow resistance of the writing-element-side relay core 21, the ink flows backward to the blocking chamber 11 from the side of the writing-element-side passage 13 before flowing into the blocking chamber 11 from the ink-chamber-side passage 12.

Since such an ink back flow causes the ink inside the ball holder of the ball chip 5 to be pulled back, the excessive ink is not pushed out to the periphery of the ball, whereby it is possible to assuredly prevent a starting portion of the writing line from forming a shape of a comma (,). In addition, the blocking chamber 11 has a small volume therein, and an amount of the ink to be pulled back as described above is small, however, which is enough to pull back the ink in the ball holder because an amount of the ink in the ball holder of the ball chip 5 is also small.

In this embodiment, in order to perform the operation for controlling the ink as described above, it is necessary to set an amount of air enclosed in the blocking chamber 11 accurately. That is, the excessive amount of the enclosed air provides a long distance between the free surface 20 of the liquid-cylindrical ink 19 held in the ink holding passage 18 and the front end of the cone portion 16 of the relay body 15. Accordingly, even when the ink in the ink storing portion 17 is consumed and the liquid-cylindrical ink 19 descends, there occurs a case that the free surface 20 does not contact the front end of the cone portion 16. When the writing instrument is continuously used for writing in such a condition, the ink in the porous relay body 15 is consumed, and decreases its amount in the ink relay body 15. As a result, the relay body 15 becomes the ink-poor condition, and may have a possibility that air is absorbed into the porous relay body 15. Once the air is thus absorbed into the porous relay body 15, the air is not eliminated assuredly even when the ink is newly absorbed into the relay body 15 as described previously, and is sent to the ball chip 5 as well as the ink, thereby resulting in a disadvantage in the writing using the ball chip 5.

When an amount of the air enclosed in the blocking chamber 11 is small, the free surface 20 of the liquid-cylindrical ink 19 contacts the front end of the cone portion 16 with the ink in ink storing portion 17 consumed little. Therefore, the operation for blocking the ink does not work, and the ink in the ink chamber 2 remains in continuous contact with the ball chip 5, whereby excessive ink is supplied to the ball chip 5 and a disadvantage arises in the writing.

In this embodiment, in order to enclose a predetermined amount of air accurately in the blocking chamber 11, applied is a producing method for filling ink as described below. The producing method will be described below with reference to FIGS. 6 to 8.

The writing instrument as described above is first assembled. In this case, the ink-chamber-side relay core 14, writing-element-side relay core 21, relay body 15 and the like are made dry with no ink contained. The ball chip 5, slide plug 3 and end plug 6 remain unattached.

Figure 6:
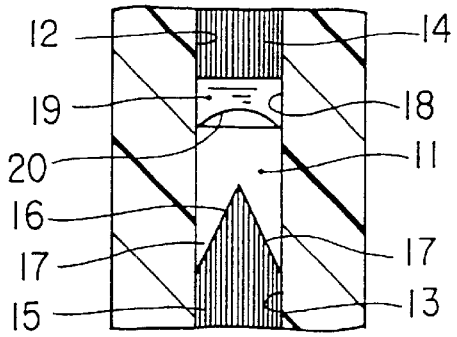
FIG. 6 is an explanatory view of a method for producing the writing instrument according to the present invention.

The writing instrument is held in a generally vertical posture with the side of the ball chip 5 directed downward, and the ink is injected into the ink chamber 2. The injected ink passes through the ink-chamber-side relay core 14 due to the gravity and capillary force, flows into the ink holding passage 18, and as shown in FIG. 6, is held in the ink holding passage 18 as the liquid-cylindrical ink 19.

In this case, the writing-element-side relay core 21 and the relay body 15 remain dry with no ink contained, and enable the air to pass therethrough. Thus, the air inside the blocking chamber 11 passes through the writing-element-side relay core 21 and relay body 15, and is evacuated from the front end portion of the writing element holder 4. Upon the evacuation of the air, the liquid-cylindrical ink 19 in the ink holding passage 18 descends.

Figure 7:
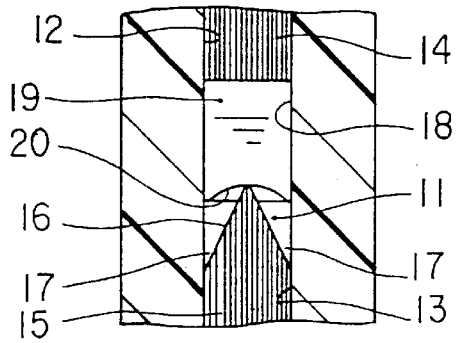
FIG. 7 is another explanatory view of the method for producing the writing instrument according to the present invention.

Then, as shown in FIG. 7, when the free surface 20 of the liquid-cylindrical ink 19 contacts the front end portion of the cone portion 16 of the relay body 15, the ink is absorbed into the relay body 15 due to the capillary force. In addition, since the size of the relay body 15 is small, the ink is instantaneously absorbed into the relay body 15. Once the ink is absorbed into the relay body 15, the air cannot pass through the relay body 15, and the air remaining inside the blocking chamber 11 is enclosed in the blocking chamber 11.

Figure 8:
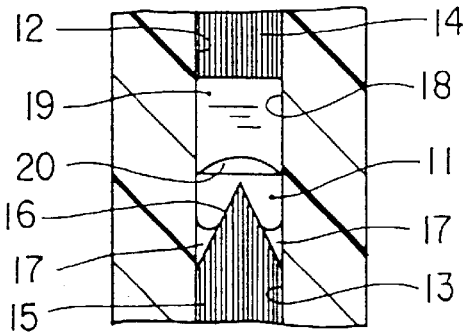
FIG. 8 is another explanatory view of the method for producing the writing instrument according to the present invention.

Next, when the entire relay body 15 and writing-element-side relay core 21 are saturated by the ink being absorbed therein and become the ink-rich condition, as shown in FIG. 8, the ink flows along the relay body 15 and is stored in the ink storing portion 17. Since the volume of the spatial portion of the blocking chamber 11 thus decreases, the pressure of the enclosed air increases, the liquid-cylindrical ink 19 is pushed up, and the free surface 20 is spaced apart from the front end of the cone portion 16 of the relay body 15. The flow of the ink is thereby halted, providing the condition that the writing instrument is not used for writing as shown in FIG. 3 described previously. The unattached parts are next attached to the writing instrument to complete the assembly thereof.

Such a method enables an accurate required amount of the air to be enclosed in the blocking chamber 11, by a simple process for holding the writing instrument in a generally vertical posture and injecting the ink into the ink chamber 2.

In addition, since the relay body 15 and writing-element-side relay core 21 have a relatively small diameter and the ink is absorbed from the front end portion of the cone portion 16 provided on the upper end, the air inside the body 15 and core 21 is pushed out to the side of the front end of the writing element holder 4 as the ink penetrates, and is not mixed with the ink in the body 15 and core 21.

In the above-mentioned method, only the case is described that the air is enclosed in the blocking chamber 11, however, a gas to be enclosed is not limited to the air. For example, in the case where particular ink is used that reacts with oxygen, nitrogen or inert gas may be enclosed in the blocking chamber 11. In such a case, prior to the process described above, the gas inside the writing instrument may be replaced with such a gas.

Figure 9:
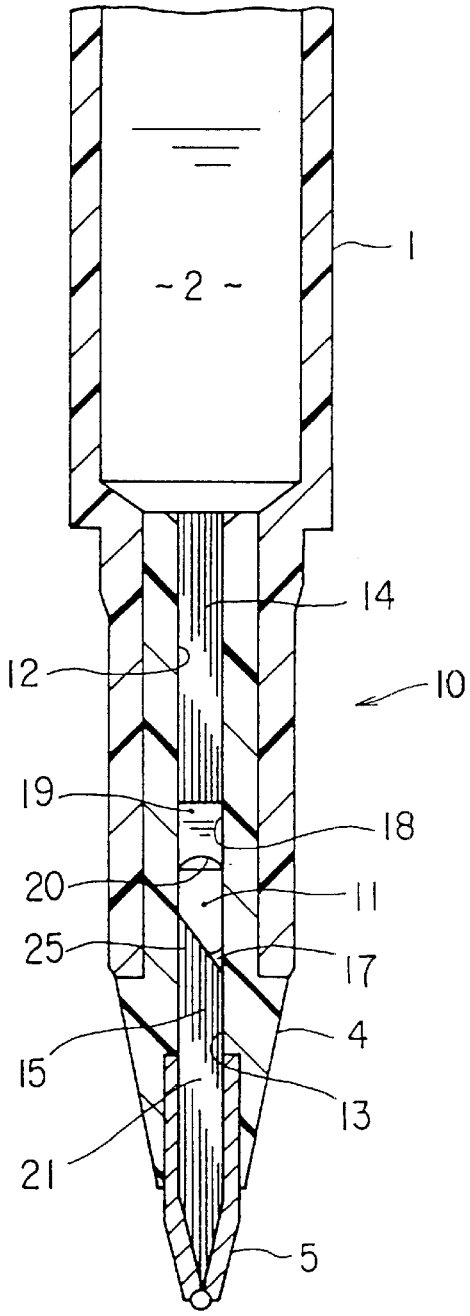
FIG. 9 is a longitudinal cross-sectional view of an ink control mechanism of a second embodiment of a writing instrument according to the present invention.

In addition, the present invention is not limited to the above-mentioned embodiment. For example, FIG. 9 shows a writing instrument of a second embodiment of the present invention.

In the second embodiment, the front end portion of the relay body 15 is cut aslant and thereby forms an aslant cut portion 25. The ink storing portion 17 with a wedge-shaped cross section is formed between the cut surface of the proximal portion of the aslant cut portion 25 and the inner periphery of the blocking chamber 11. The free surface 20 of the liquid-cylindrical ink 19 descending in the ink holding passage 18 contacts the front end portion of the aslant cut portion 25.

The writing instrument of the second embodiment has the same structure as that of the first embodiment except the point described above, and in FIG. 9, portions corresponding to the first embodiment are assigned the same reference numerals as in the first embodiment to omit the explanation thereof.

The writing instrument of the second embodiment has the same operation, producing method and the like as those of the first embodiment. In the writing instrument of the second embodiment, it is possible to form the aslant cut portion 25 only by cutting aslant a rod-shaped member made of the porous material composing the relay body 15, thereby further facilitating the production.

Figure 10:
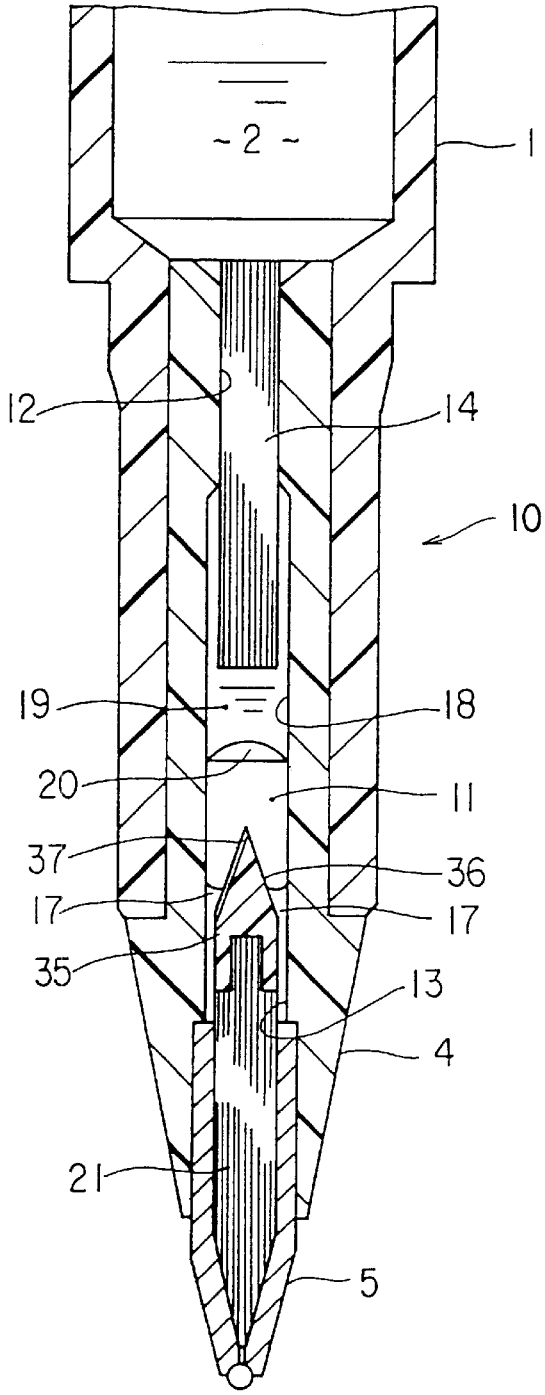
FIG. 10 is a longitudinal cross-sectional view of an ink control mechanism of a third embodiment of a writing instrument according to the present invention.

FIG. 10 shows a third embodiment of the present invention. In a writing instrument of this embodiment, the upper end portion of the writing-element-side relay core 21 is provided with a relay body 35 made of another material. The relay body 35 is formed of a material other than the porous material. The front end portion of the relay body 35 is provided with a cone portion 36 formed in a pointed cone shape. The relay body 35 is attached to the upper end portion of the writing-element-side relay core 21, and is inserted into the blocking chamber 11. A gap is formed between the outer periphery of the relay body 35 and the inner periphery of the blocking chamber 11, and the gap and the wedge-shaped gap between the base portion of the cone portion 36 and the inner periphery of the blocking chamber 11 are formed as the ink storing portion 17.

The relay body 35 is formed of a material with the wettability by ink, or undergoes coating or surface treatment to have on its surface the wettability by the ink. Further, in this embodiment, in order to guide the ink assuredly, a fine relay grove 37 is formed along the generating line on the periphery of the cone portion 36.

The structure of the third embodiment is the same as that of the first embodiment except the point described above, and in FIG. 10, portions corresponding to the first embodiment are assigned the same reference numerals as in the first embodiment to omit the explanation thereof.

The instrument of this embodiment has the same function as that of the first embodiment except that when the free surface 20 of the liquid-cylindrical ink 19 in the ink holding passage 18 contacts the front end of the cone portion 36 of the relay body 35, the ink is transferred to the ink storing portion 17 due to the wettability of the surface of the body 35 and the caterpillar force of the relay groove 37.

In this embodiment, since the relay body 35 is not of the porous material, in case that the free surface 20 of the liquid-cylindrical ink 19 does not contact the relay body 35 after the ink in the ink storing portion 17 is entirely consumed, the air is not absorbed into the relay body 35. Further, it is not necessary to process the porous material such as a bundle of fibers, and the relay body 35 can be produced readily and processed in the accurate form.

Figure 11:
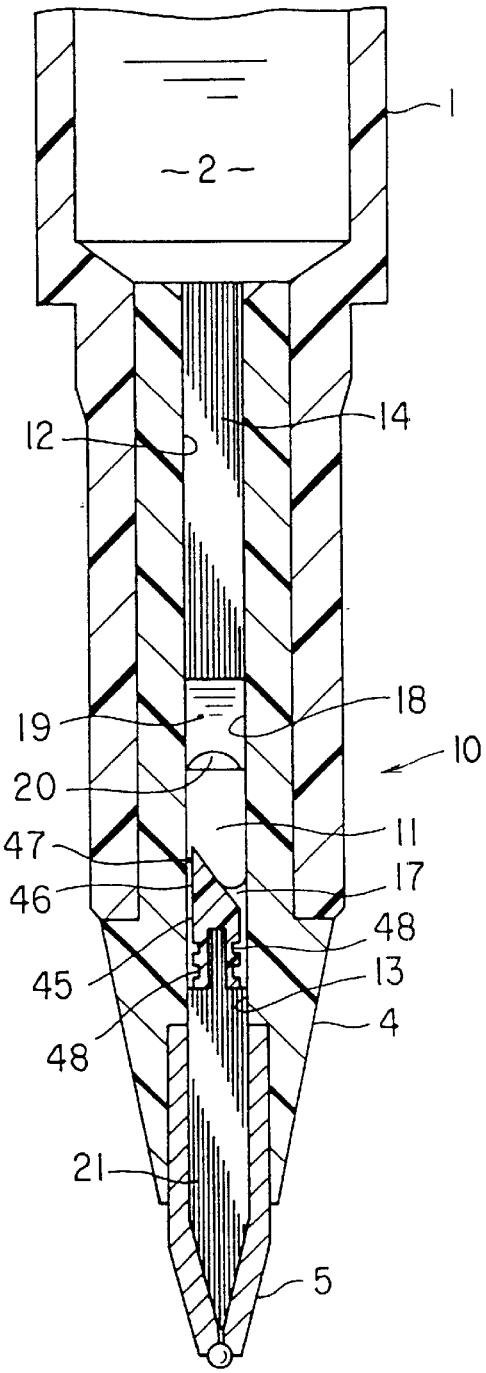
FIG. 11 is a longitudinal cross-sectional view of an ink control mechanism of a fourth embodiment of a writing instrument according to the present invention.

FIG. 11 shows a fourth embodiment of the present invention. In a writing instrument of this embodiment, the upper end portion of the writing-element-side relay core 21 is provided with a relay core 45 made of another material. The relay core 45 is formed of a material other than the porous material. The front end portion of the relay core 45 is cut aslant and thereby forms an aslant cut portion 46 in the form of a pointed shape. The relay body 45 is attached to the upper end portion of the writing-element-side relay core 21, and is inserted into the blocking chamber 11. Between the outer periphery of the relay body 45 and the inner periphery of the blocking chamber 11 is provided a gap, which is formed as a relay gap 47 that relays the ink.

A plurality of thin annular grooves in the shape of bellows is formed on the outer periphery of the proximal end portion of the relay body 45. The bellows portion and a wedge-shaped gap between the base portion of the aslant cut portion 46 and the inner periphery of the blocking chamber 11 are formed as the ink storing portion 17. The relay gap 47 communicates with the ink storing portion 17.

The relay body 45 is, as in the third embodiment, formed of a material with the wettability by ink, or undergoes coating or surface treatment to have on its surface the wettability by the ink.

The structure of the fourth embodiment is the same as that of the first embodiment except the point described above, and in FIG. 11, portions corresponding to the first embodiment are assigned the same reference numerals as in the first embodiment to omit the explanation thereof.

The instrument of this embodiment has the same function as that of the third embodiment except that when the free surface 20 of the liquid-cylindrical ink 19 in the ink holding passage 18 contacts the front end of aslant cut portion 46 of the relay body 45 and the front end of the relay gap 47, the ink is transferred to the ink storing portion 17 due to the wettability of the surface of the body 45 and the caterpillar force of the relay gap 47.

Figure 12:
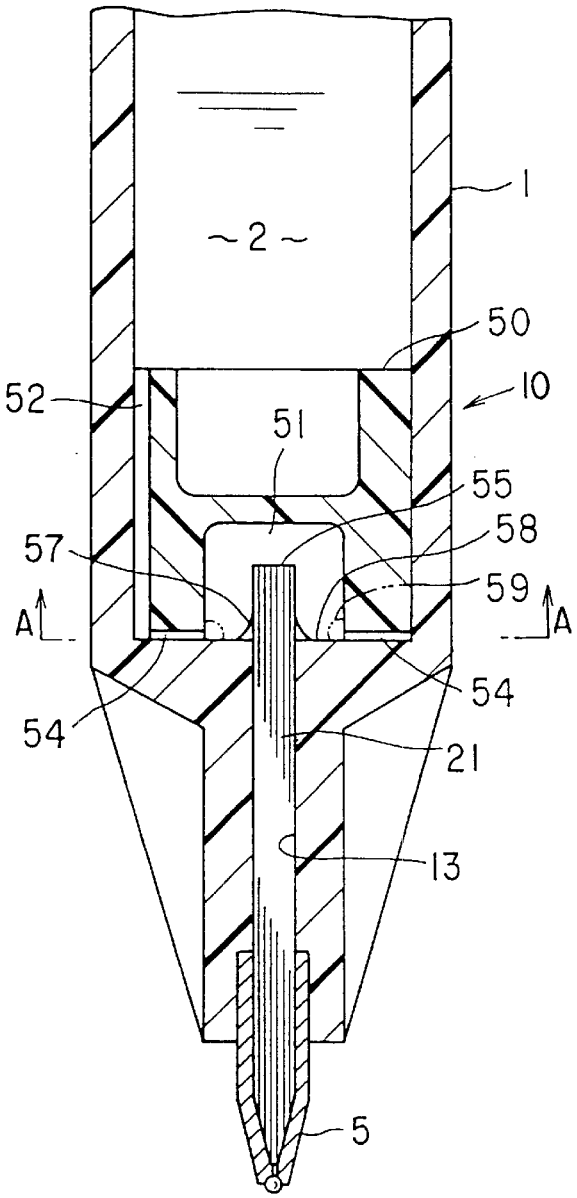
FIG. 12 is a longitudinal cross-sectional view of an ink control mechanism of a fifth embodiment of a writing instrument according to the present invention.

The present invention is not limited to the embodiments previously described, and it may be possible to provide the blocking chamber, ink storing portion, ink holding means and ink relay means with respective other structures. For example, FIG. 12 shows a fifth embodiment of the present invention.

In this embodiment, the bottom of the ink chamber 2 is formed as an ink holding surface 58 vertical to the center axis of the writing instrument. Under the ink chamber 2 is engaged with a blocking chamber member 50 in the form of a cup, and a space surrounded by a concavity portion provided in the lower portion of the member 50 and the ink holding surface 58 is formed as a blocking chamber 51.

On the outer periphery of the blocking chamber member 50 is formed an ink-chamber-side passage 52 in the axial direction. The lower end surface of the blocking chamber member 50 is provided with a restriction passage 54. The restriction passage 54 communicates on its one end with the ink-chamber-side passage 52, and is opened on its other end into the lower portion of the blocking chamber 51, while being in contact with the ink holding surface 58.

Figure 13:
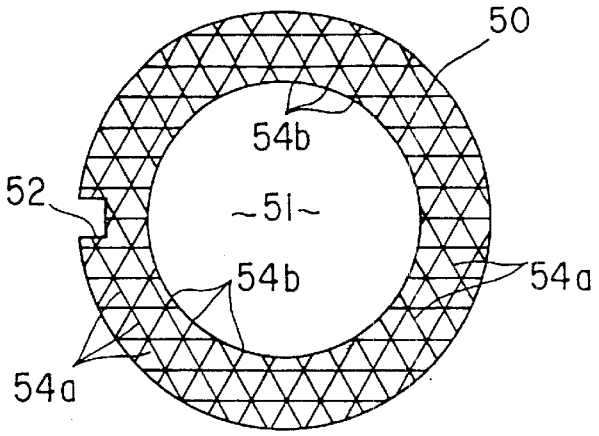
FIG. 13 is a cross-sectional view along line A—A of FIG. 12 showing an example of a restriction passage of the fifth embodiment.

The restriction passage 54 is comprised of, for example as shown in FIG. 13, a plurality of thin grooves 54*a* in the shape of a lattice formed on the lower end surface of the blocking chamber member 50, and as described previously, communicates with the ink-chamber-side passage 52, while having an ink supply opening 54*b* which is in contact with the ink holding surface 58 and which is opened into the blocking chamber 51.

Figure 14:
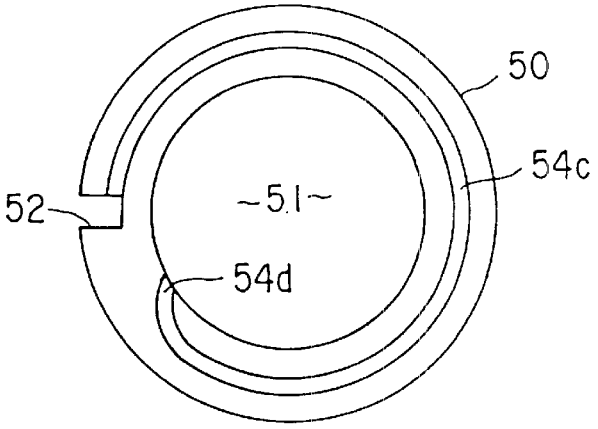
FIG. 14 is a cross-sectional view along line A—A of FIG. 12 showing another example of the restriction passage of the fifth embodiment.

Further, the restriction passage 54 may be comprised of, as shown in FIG. 14, an arc-shaped long groove 54*c* formed on the lower end surface of the blocking chamber member 50, and as described previously, may communicate with the ink-chamber-side passage 52, while having an ink supply opening 54*d* which is in contact with the ink holding surface 58 and which is opened into the blocking chamber 51.

In the center portion of the ink holding surface 58 projects the upper end portion of the writing-element-side relay core 21, and the projecting portion is formed as a relay body 55. A corner portion consisting of the base portion of the projecting relay body 55 and the ink holding surface 58 is formed as an ink storing portion 57, and the ink is stored and held in the ink storing portion due to the surface tension of the ink. An interval between the ink storing portion 57 in the base portion of the relay body 55 and the opening 54*b* or 54*d* on the outer periphery of the lower portion of the blocking chamber 51 is set to a predetermined distance.

The structure of the fifth embodiment is the same as that of the first embodiment except the point described above, and in FIG. 12, portions corresponding to the first embodiment are assigned the same reference numerals as in the first embodiment to omit the explanation thereof.

The writing instrument of this embodiment operates as described below. That is, when the instrument is not used for writing, the ink in the ink storing portion 57 is blocked and divided from the ink in the restriction passage 54 by the air enclosed in the blocking chamber 51.

Then, when the ink in the ink storing portion 57 is consumed by the writing, the volume of the spatial portion of the blocking chamber 51 increases corresponding to the consumed amount of ink, and the pressure of the air enclosed in the blocking chamber 51 decreases. The ink thereby enters the blocking chamber 51 from the ink supplying opening 54*b* or 54*d* through the ink-chamber-side passage 52 and the restriction passage 54. The entering ink is held on the corner portion between the ink holding surface 58 and the inner periphery of the blocking chamber 51 in its ridging state due to its surface tension, as shown by a two-dot-rash line 59.

When an amount of the held ink increases, the ink goes forward to the ink storing portion 57 in the center portion, and contacts the base of the relay core 55 of the ink storing portion 57. By the contact, part of the held ink is transferred to the ink storing portion 57 due to the surface tension, and the ink is stored again in the storing portion 57. Part of the ink is thus transferred, whereby the ink entering from the opening of the restriction passage 54 moves backward to be spaced from the ink storing portion 57, and the ink communication is blocked again.

Further in this embodiment, since the restriction passage 54 is provided in the ink-chamber-side passage 52, the ink flowing inside the passage is given the large flow resistance. Accordingly, as described previously, when the writing is halted, the ink in the writing-element-side passage 13 and writing-element-side relay core 21 is pulled back due to the negative pressure of the air in the blocking chamber 51, and thereby the excessive ink in the periphery of the ball of the ball chip 5 is pulled back.

When the writing instrument of this embodiment is produced, in the same way as described previously, the writing instrument is held in a generally vertical posture with the writing-element-side relay core 21 and the relay body 55 on the upper end of the core 21 both dried with no ink contained therein, and the ink is injected into the ink chamber 2. The ink flows into the lower portion of the blocking chamber 51 from the restriction passage 54, reaches the base portion of the relay body 55 while flowing along the ink holding surface 58, and is absorbed into the porous relay body 55. The ink being absorbed prevents the air from escaping through the relay body 55 and writing-element-side relay core 21, and thereby a predetermined amount of the air is accurately enclosed in the blocking chamber 51.

Figure 15:
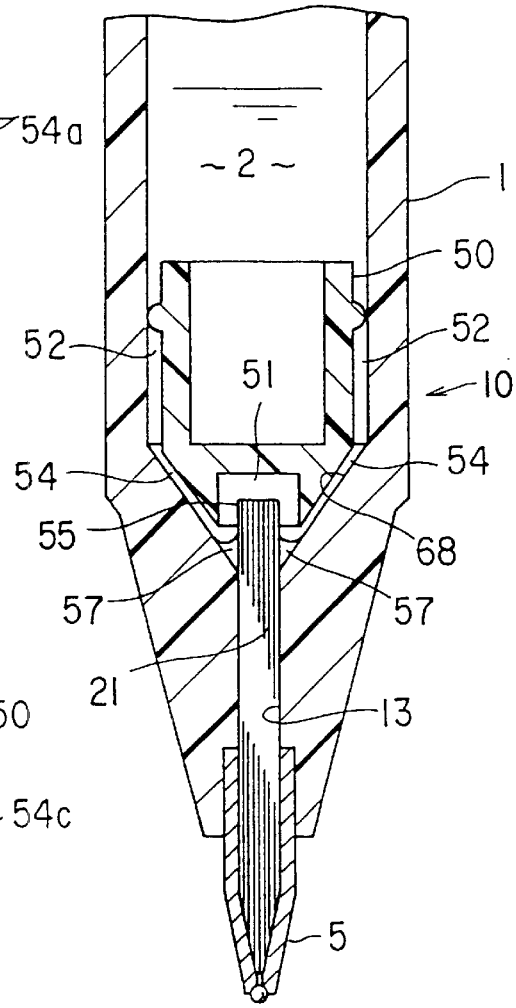
FIG. 15 is a longitudinal cross-sectional view of an ink control mechanism of a sixth embodiment of a writing instrument according to the present invention.

FIG. 15 shows a sixth embodiment of the present invention. In a writing instrument of this embodiment, the ink holding surface in the fifth embodiment is formed as an ink holding surface 68 with the shape of a cone, and corresponding to the cone shape, the lower end portion of the blocking chamber member 50 is also formed in the shape of a cone.

The structure of the sixth embodiment is generally the same as that of the fifth embodiment except the above-mentioned point, and in FIG. 15, portions corresponding to the fifth embodiment are assigned the same reference numerals as in the fifth embodiment to omit the explanation thereof.

In this embodiment, the ink storing portion 57 is formed in a portion surrounded by the bottom of the cone-shaped ink holding surface 68 and the base portion of the relay body 55 projecting from the bottom, and has the cross section in the form of a wedge, whereby as in the first embodiment, the ink is assuredly held in the ink storing portion 57.

In the fifth and sixth embodiments, the ink-chamber-side passage communicates with the lower portion of the blocking chamber, however, a portion with which the ink-chamber-side passage communicates is not limited to the lower portion of the blocking chamber, and may be the inner periphery or the upper portion of the blocking chamber. In this case, in order to hold a predetermined amount of the ink having entered the blocking chamber, it may be possible to provide an annular concavity portion around the periphery of the opening to the blocking chamber to hold the ink in the concavity portion, or to project the periphery of the opening to provide a projecting nozzle portion in the form of a pipe with a small diameter. On the front end of such a nozzle portion in the form of a pipe with a small diameter, the ink is held in the form of a sphere drop due to its surface tension.

Figure 16:
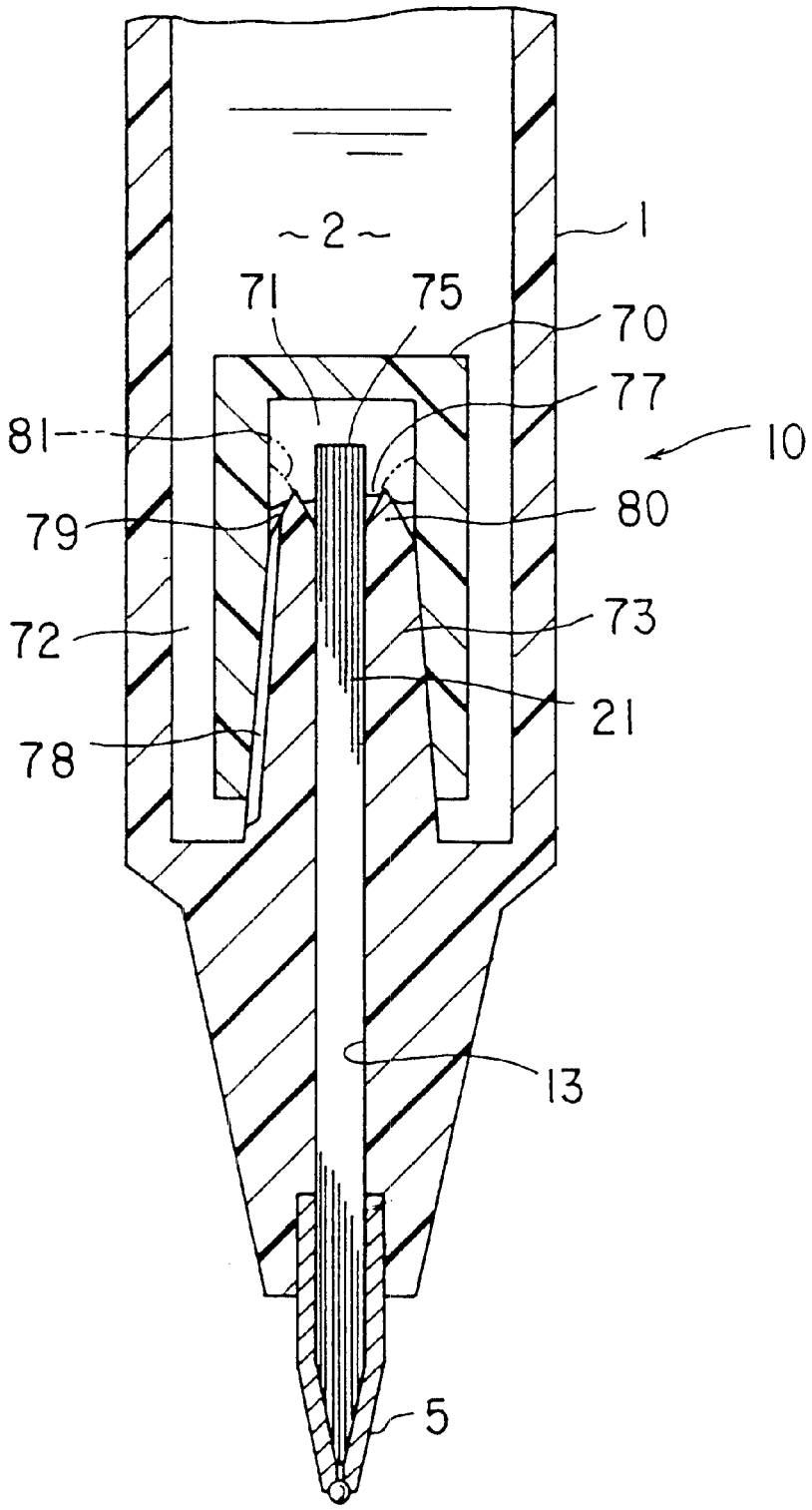
FIG. 16 is a longitudinal cross-sectional view of an ink control mechanism of a seventh embodiment of a writing instrument according to the present invention.

FIG. 16 shows a seventh embodiment of the present invention. A writing instrument of this embodiment uses an annular ridge-shaped projecting portion as the ink holding means and the relay means.

That is, in this embodiment, on the bottom of the ink chamber 2 is formed an engaging projecting portion 73 in the form of a cone, a cup-shaped blocking chamber member 70 is engaged with the engaging projecting portion 73, and a space surrounded by the inner surface of the blocking chamber member 70 and the upper surface of the engaging projecting portion 73 is formed as a blocking chamber 71. The upper end portion of the writing-element-side relay core 21 projects inside the blocking chamber 71 from the center portion of the engaging projecting portion 73, and the projecting portion of the core 21 is formed as a relay body 75. Between the outer periphery of the blocking chamber member 71 and the inner periphery of the ink chamber 2 is formed a gap, which is formed as an ink-chamber-side passage 72. A thin restriction groove 78 is formed on the outer periphery of the engaging projecting portion 73, and communicates with the ink-chamber-side passage 72, while being opened into the periphery of the lower portion of the blocking chamber 71.

On the upper surface of the engaging projecting portion 73 forming the bottom of the blocking chamber 71, an annular ridge-shaped projecting portion 80 with the mountain-shaped cross section is formed surrounding the projecting relay body 75. A gap portion with the wedge-shaped cross section between the slant inner periphery of the projecting portion 80 and the base portion of the relay body 75 is formed as an ink storing portion 77. An annular concavity groove portion formed by the slant outer periphery of the projecting portion 80 and the inner periphery of the blocking chamber 71 is formed as an ink holding portion 79. The restriction groove 78 communicates with the ink holding portion 79.

The structure of the seventh embodiment is the same as that of the fifth embodiment except the point described above, and in FIG. 16, portions corresponding to the fifth embodiment are assigned the same reference numerals as in the fifth embodiment to omit the explanation thereof When the writing instrument of this embodiment is not used for writing, the ink in the ink storing portion 77 is blocked and divided from the ink in the ink holding portion 79 by the ridge-shaped projecting portion 80. Then, when the ink in the ink storing portion 77 is consumed by the writing, the volume of the spatial portion of the blocking chamber 71 increases corresponding to the consumed amount of ink, and the pressure of the air enclosed in the blocking chamber 71 decreases. The ink thereby enters the ink holding portion 79 through the ink-chamber-side passage 72 and restriction groove 78. The entering ink ridges on the vertex of the ridge-shaped projecting portion 80 due to its surface tension, as shown by a two-dot-rash line 81 in FIG. 16, and is held temporarily.

When an amount of the entering ink exceeds a predetermined amount, part of the ink climbs over the ridge-shaped projecting portion 80, flows into the ink storing portion 77, and is stored and held in the ink storing portion 77. Such an operation is repeated to control the ink to supply.

The writing instrument of this embodiment is capable of arbitrarily setting ink holding amounts of the ink storing portion 77 and of the ink holding portion 79, by setting the diameter of the blocking chamber 71 and the form of the ridge-shaped projecting portion 80, and thereby has the feature for providing a large degree of the freedom of design.

The present invention is not limited to the above-mentioned embodiments. For example, the structure of the ink chamber of the writing instrument of the present invention is not limited to those described above. The above-mentioned embodiments are of the writing instrument of the ball chip type using water-soluble ink, but may be also applicable to a writing instrument using oil-soluble ink or fast-drying ink. The kind of the writing element is not limited to a ball chip, and may be a felt chip or other writing element. The present invention is not limited to the disposable type of writing instrument, and may be applicable to a writing instrument enabling ink replenishment or the refill type of writing instrument.

INDUSTRIAL APPLICABILITY

As described above, in the writing instrument of the present invention, when the instrument is not used for writing, the communication of the ink between the ink chamber and writing element is blocked by a gas such as air enclosed in the blocking chamber, and the ink is thereby prevented from being supplied undesirably to the writing element.

Then, when the ink is consumed by the writing, the ink entering the blocking chamber is transferred to the ink storing portion, thereby storing the ink in the ink storing portion again, and such an operation is repeated to supply the ink to the writing element, whereby the instrument does not require a mechanically movable portion, and enables the opening and closing operation to be performed assuredly by slight pressure difference.

Further, since the blocking and communication of the ink by the enclosed air is performed by increase and decrease in an amount of the ink stored and held in the ink storing portion, it is not necessary to perform operations in the porous member for absorbing air, causing the ink to penetrate, eliminating the air, and the like, thereby providing great effects of having reliable operation and simple structure.

Furthermore, the producing method of the present invention is capable of enclosing a required predetermined amount of a gas in the blocking chamber, by a simple operation for holding the writing instrument in its dry state in a generally vertical posture and injecting the ink into the ink chamber, and thereby provides great effects such that writing instruments with accurate characteristics can be produced efficiently and assuredly.

What is claimed is:

1. A writing instrument provided with an ink chamber that stores ink, a writing element provided on a front end portion of said writing instrument, and an ink control mechanism provided between said ink chamber and said writing element, said ink control mechanism comprising:

a blocking chamber with a gas enclosed therein;

an ink-chamber-side passage for causing said blocking chamber to communicate with said ink chamber;

a writing-element-side passage for causing said blocking chamber to communicate with said writing element;

ink holding means for holding the ink entering said blocking chamber from said ink-chamber-side passage at a predetermined position in said blocking chamber;

an ink storing portion which is formed in said blocking chamber, and which stores and holds a small amount of the ink, movement of the ink held by said ink holding means to said ink storing portion being blocked by said gas held by the blocking chamber, while said small amount of the ink communicates with said writing-element-side passage; and ink relay means for transferring, when an amount of the ink held by said ink holding means is equal to or more than a predetermined amount, at least part of the held ink to said ink storing portion.

2. The writing instrument according to the claim 1, wherein said ink holding means forms an ink holding passage which communicates with said blocking chamber and with said ink-chamber-side passage, and which has a small cross-sectional area enabling the ink to be held in a liquid-cylindrical form in said ink holding passage due to a surface tension of the ink and further enabling the ink and the gas not to be exchanged in their positions.

3. The writing instrument according to claim 1, wherein said ink holding means comprises an ink holding surface which is formed under said blocking chamber to cross the axial direction of said writing instrument, and part of which is provided with said ink storing portion, and an ink supplying opening which is opened adjacent said ink holding surface at a position spaced apart from said ink storing portion, and which communicates with said ink-chamber-side passage.

4. The writing instrument according to claim 1, wherein said ink holding means comprises a ridge-shaped projecting portion which is formed between said ink storing portion formed in said blocking chamber while communicating with said writing-element-side passage and an ink supplying opening opened into said blocking chamber while communicating with said ink-chamber-side passage, to divide said ink storing portion and said ink supplying opening, and which prevents a flow of the ink supplied from said ink supplying opening while enabling the ink to climb over said ridge-shaped projecting portion.

5. The writing instrument according to claim 1, wherein said ink relay means forms a relay body having wettability by the ink which is disposed on its one end adjacent said ink holding means, and which communicates on its other end with said ink storing portion.

6. The writing instrument according to claim 5, wherein said relay body is formed of a porous material.

7. The writing instrument according to claim 5, wherein said ink storing portion forms a corner portion formed in a base portion of said relay body of ink provided to project in said blocking chamber.

8. The writing instrument according to claim 5, wherein said ink storing portion forms a gap with a wedge-shaped cross section formed between a proximal portion of a pointedly formed front end portion of said relay body of ink provided to project in said blocking chamber and to have the pointedly formed front end portion, and an inner periphery of said blocking chamber.

9. The writing instrument according to claim 5, wherein said ink storing portion forms a gap with a wedge-shaped cross section formed between a base portion of said relay body of ink provided to project in said blocking chamber, and a cone-shaped concavity portion formed on a bottom of said blocking chamber to surround said base portion of said relay body.

10. The writing instrument according to claim 1, wherein said ink relay means forms a relay gap which is formed between a relay body provided in said blocking chamber and an inner surface of said blocking chamber, which is disposed on its one end adjacent said ink holding means, and which communicates on its other end with said ink storing portion.

11. The writing instrument according to claim 1, wherein said ink relay means forms a relay groove which is formed in a relay body provided in said blocking chamber, which is disposed on its one end adjacent said ink holding means, and which communicates on its other end with said ink storing portion.

12. The writing instrument according to claim 1, wherein said blocking chamber has an inner diameter enabling the ink to be held in a liquid-cylindrical form in one end portion thereof, has a predetermined amount of the gas enclosed therein, and further has an ink relay body which projects into said blocking chamber from a side of the other end portion thereof, which communicates in its proximal end portion with said writing-element-side passage, which has a front end portion formed in a pointed shape being disposed adjacent a free surface of the ink held in a liquid-cylindrical form in said blocking chamber, and which transfers part of the ink to said writing-element-side passage by contacting the free surface.

13. The writing instrument according to claim 12, wherein said ink relay body transfers the ink to said writing-element-side passage by capillary force.

14. The writing instrument according to claim 12, wherein said ink relay body transfers the ink to said writing-element-side passage by wettability of a surface thereof.

15. The writing instrument according to claim 12, wherein said ink relay body has the front end portion in the form of a cone.

16. The writing instrument according to claim 15, wherein between an outer periphery of a proximal portion of the front end portion in the form of a cone of said ink relay body and an inner periphery of said blocking chamber is formed said ink storing portion in the form of a ring with a wedge-shaped cross section.

17. The writing instrument according to claim 12, wherein said ink relay body has the front end portion in the form of an aslant cut shape.

18. The writing instrument according to claim 17, wherein between a proximal portion of an aslant cut portion in the front end portion of said ink relay body and an inner periphery of said blocking chamber is formed said ink storing portion with a wedge-shaped cross section.

19. The writing instrument according to claim 12, wherein said ink relay body has the front end portion provided with a projecting portion with a small diameter.

20. The writing instrument according to claim 19, wherein in a base portion of said projecting portion in the front end portion of said relay body is formed said ink storing portion.

21. The writing instrument according to claim 12, wherein said ink relay body is formed of a porous material.

22. The writing instrument according to claim 12, wherein said ink relay body has the front end portion provided with a relay groove capable of transferring the ink to a proximal end side from a front end side due to a capillary force thereof.

23. The writing instrument according to claim 12, wherein between an outer periphery of the front end portion of said ink relay body and an inner periphery of said blocking chamber is formed a relay gap capable of transferring the ink to a proximal end side from a front end side of said ink relay due to a capillary force thereof.

24. The writing instrument according to claim 12, wherein a porous relay core is inserted into said ink-chamber-side passage.

25. A method for producing the writing instrument according to claim 1, said method comprising the steps of:

holding said writing instrument in a generally vertical posture with said writing element directed downward, and having no ink in said ink control mechanism;

injecting the ink into said ink chamber;

evacuating the gas in said ink chamber and said blocking chamber through said ink relay means, thereby filling the ink injected into said ink chamber to said ink holding means of said ink control mechanism; and halting the evacuation of the gas through the ink relay means by flowing the injected ink to the ink relay means in the ink control mechanism thereby enclosing the gas with a predetermined amount remaining in said blocking chamber.

* * * * *